US010820765B2

(12) United States Patent
Blum

(10) Patent No.: US 10,820,765 B2
(45) Date of Patent: Nov. 3, 2020

(54) AUTOMATICALLY MOVING FLOOR PROCESSING DEVICE

(71) Applicant: Vorwerk & Co. Interholding GmbH, Wuppertal (DE)

(72) Inventor: Michael Blum, Wuppertal (DE)

(73) Assignee: Vorwerk & Co. Interholding GmbH, Wuppertal (DE)

( * ) Notice: Subject to any disclaimer, the term of this patent is extended or adjusted under 35 U.S.C. 154(b) by 217 days.

(21) Appl. No.: 16/100,506

(22) Filed: Aug. 10, 2018

(65) Prior Publication Data

US 2019/0045988 A1 Feb. 14, 2019

(30) Foreign Application Priority Data

Aug. 11, 2017 (DE) ..... 10 2017 118 402

(51) Int. Cl.

| | |
|---|---|
| ***A47L 9/06*** | (2006.01) |
| ***A47L 9/04*** | (2006.01) |
| ***A47L 9/00*** | (2006.01) |
| ***A47L 11/40*** | (2006.01) |
| *A47L 9/28* | (2006.01) |

(52) U.S. Cl.

CPC ..... *A47L 9/0666* (2013.01); *A47L 9/009* (2013.01); *A47L 9/0411* (2013.01); *A47L 9/0477* (2013.01); *A47L 11/4066* (2013.01); *A47L 9/2847* (2013.01); *A47L 9/2852* (2013.01); *A47L 2201/00* (2013.01); *A47L 2201/04* (2013.01)

(58) Field of Classification Search

CPC ..... A47L 11/4066; A47L 2201/00; A47L 2201/04; A47L 9/009; A47L 9/0411; A47L 9/0477; A47L 9/0666; A47L 9/2847; A47L 9/2852

See application file for complete search history.

(56) References Cited

U.S. PATENT DOCUMENTS

2004/0074039 A1* 4/2004 Kim ..... E01H 1/0845 15/319

FOREIGN PATENT DOCUMENTS

| | | | | |
|---|---|---|---|---|
| DE | 10200706075 A1 * | 6/2009 | ..... | A47L 9/0455 |
| DE | 102012109970 A1 * | 5/2014 | ..... | A47L 9/02 |
| DE | 102015114265 A1 * | 3/2017 | ..... | A47L 9/02 |
| KR | 20030085165 A * | 11/2003 | | |
| WO | WO-2015076630 A1 * | 5/2015 | ..... | A47L 9/0477 |

OTHER PUBLICATIONS

DE 102007060750 A1—English Machine Translation (Year: 2009).*

* cited by examiner

*Primary Examiner* — Marc Carlson
(74) *Attorney, Agent, or Firm* — Collard & Roe, P.C.

(57) ABSTRACT

An automatically moving floor processing device has a housing, at least one drive element that is driven by an electric motor and can rotate around a drive axle for movement purposes, and at least one contact element that moves ahead of the drive element in the direction of movement, which extends from a housing underside of the housing in the direction of a surface to be processed. In order to make it easier to overcome obstacles, a contact surface of the contact element pointing in the direction of movement and/or a connecting line that connects the contact surfaces of two contact elements be oriented nonparallel to the drive axle of the drive element, and be spaced apart from a contact surface of the drive element by a distance relative to the direction of movement that is less than one diameter of the drive element.

10 Claims, 4 Drawing Sheets

AUTOMATICALLY MOVING FLOOR PROCESSING DEVICE

CROSS REFERENCE TO RELATED APPLICATIONS

Applicant claims priority under 35 U.S.C. § 119 of German Application No. 10 2017 118 402.3 filed on Aug. 11, 2017, the disclosure of which is incorporated by reference.

BACKGROUND OF THE INVENTION

1. Field of the Invention

The invention relates to an automatically moving floor processing device with a housing, at least one drive element that is driven by an electric motor and can rotate around a drive axle for movement purposes, and at least one contact element that moves ahead of the drive element in the direction of movement, which extends from a housing underside of the housing (8) in the direction of a surface to be processed.

2. Description of the Related Art

Floor processing devices of the aforementioned kind are known in prior art. For example, these involve vacuuming and/or wiping robots, which autonomously traverse a surface, and in so doing can perform floor processing tasks such as vacuuming, wiping or the like. The floor processing device can also be a polishing device, grinding device or the like. For movement purposes, the floor processing device has one or more electric motor-driven drive elements, which roll off onto the traversed surface, and in so doing cause the floor processing device to move. The drive element is usually a wheel of the floor processing device or a driven working element, for example a bristle roller or wiping roller. The spatial orientation of the drive axle of the drive element simultaneously defines the direction of movement of the floor processing device. For example, the contact element can be a passively concurrently rolling support wheel of the floor processing device, which moves ahead of the drive element in the direction of movement, and supports the floor processing device in relation to the surface to be processed. A floor processing device usually has two of more such support wheels. As the floor processing device approaches an obstacle, for example a door threshold or carpet edge, the support wheel initially hits the obstacle. Once the support wheel has overcome the obstacle, the drive element comes into contact with the obstacle.

In order for the support wheel or drive element to overcome the obstacle, it is necessary that the drive elements of the floor processing device exert a corresponding force on the surface to be processed. Depending on the height of the obstacle, the diameter of the drive element or a drive power of the floor processing device, overcoming an obstacle might pose problems.

SUMMARY OF THE INVENTION

Proceeding from the aforementioned prior art, the object of the invention is to configure the floor processing device in such a way that obstacles can be more easily overcome.

To achieve this object, it is proposed that a contact surface of the contact element pointing in the direction of movement and/or a connecting line that connects the contact surfaces of two contact elements be oriented nonparallel to the drive axle of the drive element, and be spaced apart from a contact surface of the drive element by a distance relative to the direction of movement that is less than one diameter of the drive element.

Due to the inclined position of the contact surface or contact surfaces relative to the drive axle of the drive element—and hence to the direction of movement of the floor processing device—proposed by the invention, contact between the contact surface of the contact element or contact surfaces of the contact elements and the obstacle causes the floor processing device to be positioned at an inclination on the obstacle owing to the continued driving of the drive element(s), as a result of which the drive axle of the drive element is not parallel to the edge of the obstacle. As a consequence, only one of two drive elements or only one end area of a single drive element initially comes into contact with the obstacle, so that the respective other drive element or the opposing end area of the drive element continues to optimally exert force on the traversed surface so as to overcome the obstacle. As a result of the inventive feature in which the contact surface or connecting line is spaced apart from a contact surface of the drive element by a distance relative to the direction of movement of the floor processing device that is smaller than a diameter of the drive element, the contact surface or connecting line is located just in front of a drive element in the direction of movement. As a consequence, the floor processing device is thus forced into an inclined position by the floor processing device, specifically the contact element, hitting an obstacle, chronologically just before the drive element makes contact with the obstacle. It is especially preferable that the distance between the contact surface or connecting line and the drive element approach zero, so that the contact surface or connecting line or a straight elongation of the latter touches the drive element. This preferred embodiment makes it possible to prevent the floor processing device from being diverted into another direction again after successfully being placed in an inclined position, specifically by floor unevenness or the like, for example, before the drive element has reached the obstacle. As a whole, this improves the climbing characteristics of the floor processing device, in particular when driving over obstacles relatively slowly. The floor processing device can now drive over an obstacle more reliably, in particular without several failed attempts, thereby shortening the time required for a floor processing cycle. This in turn makes it possible to increase the number of floor processing cycles per battery charge.

The contact element can either be a contact element that touches the surface to be processed with the floor processing device in the use position, for example a support wheel or guide roller, or a contact element which does extend underneath the housing toward the surface to be processed in the use position, but is spaced apart therefrom. In the latter case, the contact element preferably is spaced less than roughly 10 mm apart from the surface with the floor processing device in the use position, thereby enabling contact with traversable obstacles, such as door thresholds or carpet edges. One end area of the contact element facing the surface can preferably have a roller or sliding element, which allows the obstacle to be passed given a continued movement by the floor processing device. The contact element can here especially preferably have allocated to it a spring element, which displaces the contact element once the restoring force has been overcome by the drive force of the floor processing device.

It can be provided that the contact element and/or contact elements be unsymmetrically arranged on the floor processing device in relation to a central line that bisects the drive axle, and is situated transverse to the drive axle. In prior art, the elements that intersect the housing underside of the housing, such as the drive elements and support wheels, are usually arranged symmetrically to a central line of the drive axle or a symmetrical central line of the housing underside. The support wheels are here arranged in such a way that the latter are each spaced identical distances apart from the central line. By contrast, it is now proposed that the contact elements be arranged unsymmetrically to the central line, and hence also unsymmetrically to the drive elements. This makes it possible to achieve the advantageous inclined position of the drive axle of the drive element relative to the obstacle described above.

In addition, it is proposed that the floor processing device have two contact elements, which are laterally offset relative to each other one behind the other in relation to the direction of movement. According to this embodiment, two—or even several—contact elements are arranged on the floor processing device in such a way that they hit an obstacle to be overcome in a delayed manner during the movement of the floor processing device. Because the contact elements are arranged one behind the other in the direction of movement, contact is initially only made with the first contact element arranged in the direction of movement, while a second contact element arranged thereafter is still spaced apart from the obstacle.

In particular, it is proposed that the floor processing device have at least two drive elements, whose drive axles lie on a shared line, or which have a shared drive axle. According to this embodiment, for example, the floor processing device has two driven wheels, which rotate around a shared drive axle or around two drive axles that are formed separately but oriented parallel to each other. If the drive elements have separate drive axles, the drive axles lie on a shared line.

In addition, it is proposed that the contact elements be spaced apart from each other by a distance of a few millimeters in a direction orthogonal to the drive axle. The direction orthogonal to the drive axle corresponds to the direction of movement of the floor processing device. Proposed in particular is a distance between the contact elements of 3 mm to 10 mm, especially preferably of 4 mm to 6 mm. Practice has shown that already shifting the contact elements by roughly 4 mm orthogonal to the drive axle is enough to enable a delayed arrival of the drive elements at the obstacle or an initially only unilateral approach by an end area of the drive element to the obstacle.

Within the meaning of the invention, a drive element can be a motor-driven wheel or a motor-driven floor processing roller of the floor processing device. For example, an embodiment of a floor processing device is also conceivable in which the latter has no separate motor-driven wheels, with the floor processing device instead being moved by at least one motor-driven floor processing roller, which simultaneously performs the floor processing of the surface. In particular, the floor processing device can also have two floor processing rollers, the drive axles of which are not oriented parallel to each other. One of the floor processing rollers here represents the contact element defined as such here, so that when one of the floor processing rollers comes into contact with an obstacle, the position of the respective other floor processing roller is correspondingly inclined relative to the obstacle, and the latter can thus be overcome especially advantageously based on the proposed mode of action by the driving force of the other floor processing roller.

In addition, it is proposed that the contact element of the floor processing device be a motor-driven wheel, a guide wheel that passively co-rotates during the movement of the floor processing device, or a floor processing element. A proposed contact element can thus either be actively driven or passively co-rotate during a movement. Since a motor-driven drive element is always used in combination with a non-actively driven contact element, the floor processing device can be pulled at an obstacle to be overcome. For example, the contact elements can be support wheels of the floor processing device or also passively rotating floor processing elements, which exert a frictional force on the surface to be processed. In addition, however, a contact element can also be arranged and designed on the floor processing device in such a way as not even to touch the surface to be processed at all. In this embodiment, the contact element does not serve as a support relative to the surface, but rather comes into contact with an obstacle that rises from the surface to be processed. In an especially simple case, the contact element is a projection that protrudes toward the surface below the housing. The contact element preferably is spaced apart from the surface to be processed by a distance less than the height of obstacles usually to be overcome, such as door thresholds and carpet edges.

An especially preferred embodiment proposes that the contact element move ahead of the drive element in relation to a usual movement of the floor processing device in the forward direction. The contact element that forces the floor processing device into an inclined position or the several contact elements acting in this manner produce the inclined position of the floor processing device when the floor processing device moves toward the obstacle in a usual forward direction, so that the contact element(s) initially come(s) into contact with the obstacle chronologically before the drive element. In like manner, however, it can also be provided that the floor processing device be equipped in such a way as to initially only come into contact with one or several contact elements additionally or only when moving in a reverse direction, and only then with the drive element(s).

It is proposed that the drive axle of the drive element and a contact surface of the contact element or a connecting line connecting two contact elements have an angle unequal to zero relative to each other. In particular, it is proposed that the angle be more than 5° and less than 15°. The angle especially preferably measures more than 5° and less than 10°. The proposed angular range simultaneously defines the inclined position of the floor processing device at an obstacle. For example, given an angle of 10° between the contact surface or connecting line and the drive axle, the floor processing device is inclined by 10° relative to the previous direction of movement. The floor processing device thus deviates from the previous straight direction of movement and travels over an edge of an obstacle at an inclination, so that the new direction of movement is not oriented orthogonally to a threshold or edge of the obstacle. If necessary, the inclined position of the floor processing device can again be corrected by a navigation and self-localization device of the floor processing device after the floor processing device has completely overcome the obstacle, so that the floor processing device continues to travel along a planned course of movement.

BRIEF DESCRIPTION OF THE DRAWINGS

The invention will be described in more detail below based on exemplary embodiments. Shown on:

FIG. 7 is another embodiment of a floor processing device according to the invention.

DETAILED DESCRIPTION OF THE PREFERRED EMBODIMENTS

Figure 1:
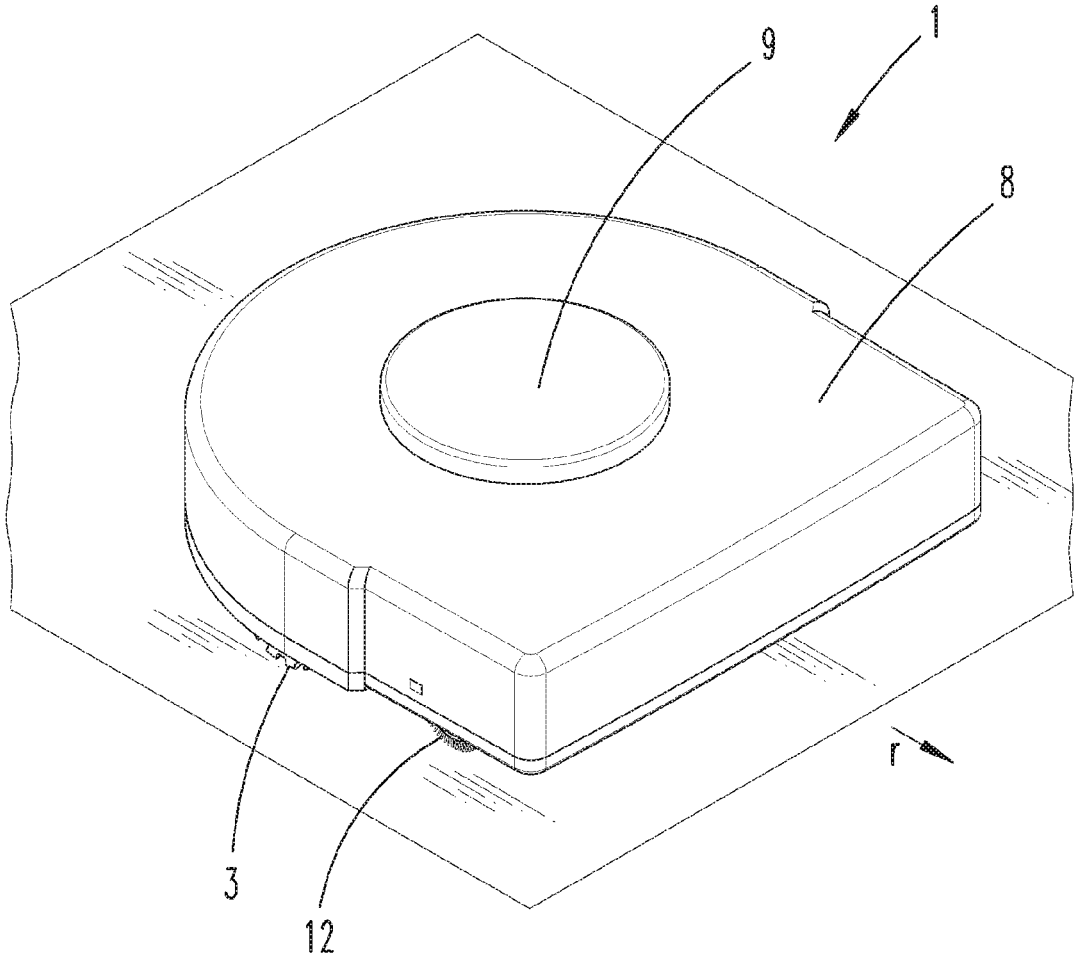
FIG. 1 is a perspective view of a floor processing device according to the invention.

FIG. 1 shows a floor processing device 1 according to the invention, which here is designed as a vacuuming robot. The floor processing device 1 automatically travels over a surface, and for this purpose has a navigation and self-localization device, which enables an orientation within premises and the generation of an area map. The floor processing device 1 has two drive elements 3 and several contact elements 5, 11, 12, of which only a contact element 12 designed as a bristle roller is visible on FIG. 1. The floor processing device 1 is supported on the cleaning surface via the drive elements 3 on the one hand, and via the contact elements 5 on the other, wherein both the drive elements 3 and the contact element 12 designed as a bristle roller are motor driven. The floor processing device 1 has a forward direction r, which is prescribed by the orientation of a drive axle 2 of the drive elements 3, and corresponds to the unrolling direction of the drive elements 3.

Arranged in a housing 8 of the floor processing device 1 is a distance measuring device 9, which measures distances from obstacles 10 within the environment of the floor processing device 1. For example, the distance measuring device is here designed as a triangulation measuring device, which can measure distances from obstacles 10 preferably in an angular range of 360°. The distance measuring device 9 is part of the navigation and self-localization device of the floor processing device 1.

Figure 3:
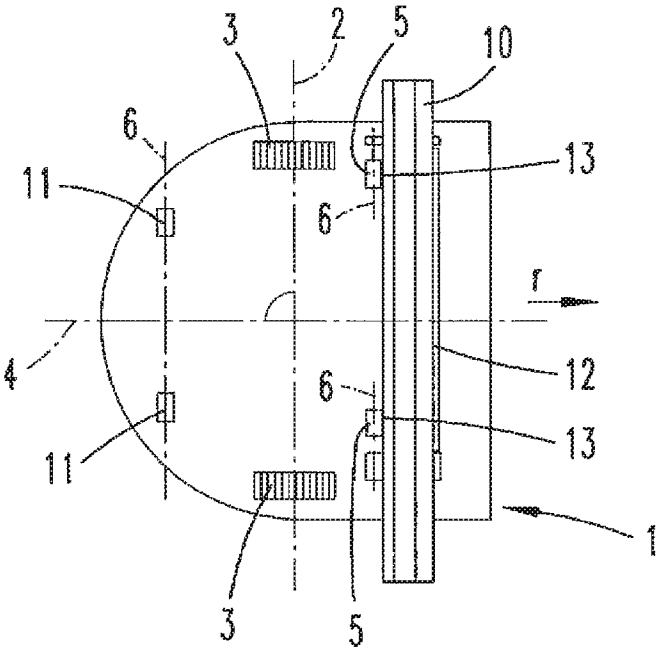
Fig. 3 Prior Art
FIG. 3 is the floor processing device according to FIG. 2 while overcoming an obstacle.
Figure 2:
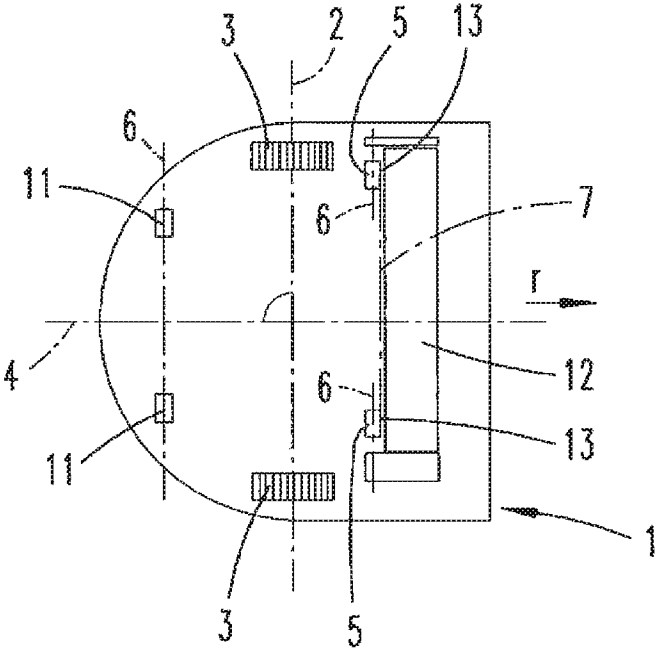
Fig. 2 Prior Art
FIG. 2 is a bottom view of a floor processing device according to prior art.

FIGS. 2 and 3 initially show a bottom side of a floor processing device 1 according to prior art. Specifically, the floor processing device 1 has two motor-driven drive elements 3, which here are driven by an electric motor via a shared drive axle 2. In addition, the floor processing device 1 has a plurality of contact elements 5, 11, 12, of which contact elements 11 and contact elements 5 are each arranged in pairs. The contact elements 5, 11, 12 each have a contact surface 13 pointing in the direction of movement, which is oriented parallel to the drive axle 2 of the drive elements 3. The contact elements 5 and 11 are support wheels that passively roll onto the surface during a movement of the floor processing device 1. The contact element 12 is the bristle roller already mentioned above, which can be driven by a motor for processing the surface to be cleaned with brushes. The rotational axes 6 of the contact elements 5 or rotational axes 6 of the contact elements 11 lie on a shared line. The central line 4 depicted on FIG. 2 is defined for describing the invention in more detail; it is orthogonally oriented relative to the drive axle 2, and bisects the drive axle 2. The central line 4 is oriented parallel to the usual forward direction r of the floor processing device 1.

FIG. 3 presents a situation in which the floor processing device 1 hits an obstacle 10 that can be overcome by the floor processing device 1. For example, the obstacle 10 here is a door threshold. As the floor processing device 1 moves in the forward direction r, the contact surface 13 of the contact element 12 initially hits the obstacle 10 at a first point in time. At a later, second point in time, the contact surfaces 13 of the two contact elements 5 lying behind hit the contact surfaces 13 simultaneously. The resistance offered to the floor processing device 1 by the obstacle 10 must be overcome by the drive elements 3 of the floor processing device 1, so that the contact elements 5, 12 can be pushed over the obstacle 10. As soon as the contact elements 5, 12 have overcome the obstacle 10, the two drive elements 3 simultaneously hit the obstacle 10 during the continued movement of the floor processing device 1. Since both drive elements 3 are simultaneously supported on the surface and must drive up onto the obstacle 10, it becomes more difficult to cross the obstacle 10.

As opposed to the prior art described above, FIGS. 4 to 7 show three different embodiments which make it easier to overcome an obstacle 10. The depicted embodiments here relate only to a selection from a plurality of other possible embodiments, and are not to be construed as limiting.

Figure 5:
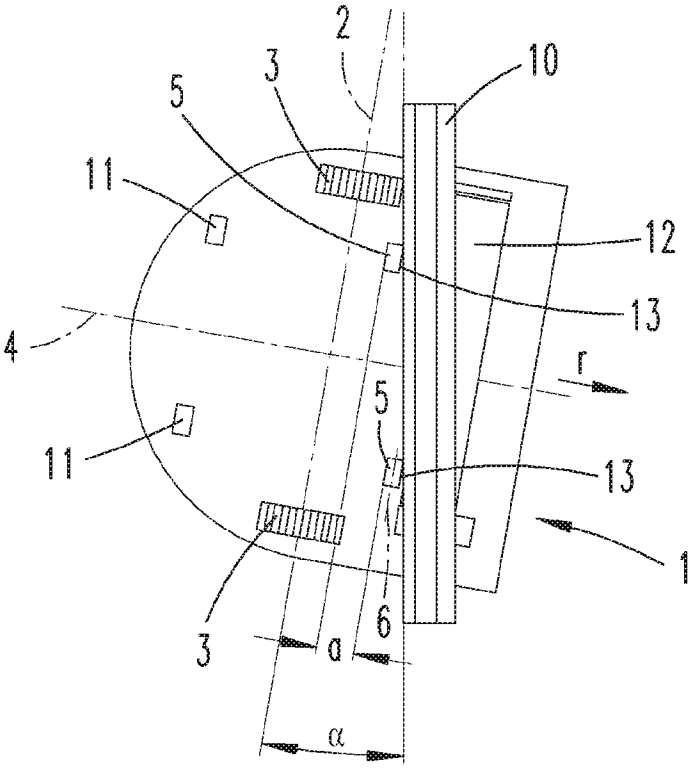
FIG. 5 is the floor processing device according to FIG. 4 while overcoming an obstacle.
Figure 4:
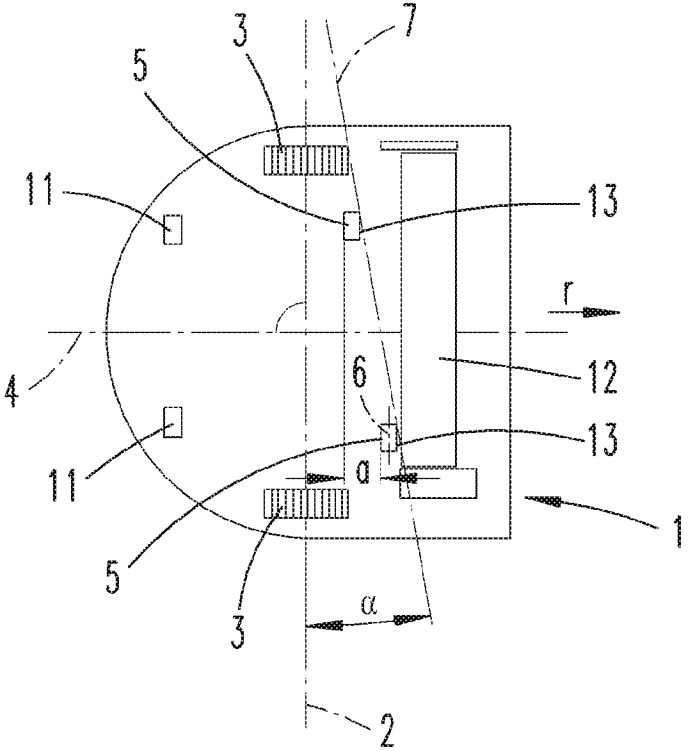
FIG. 4 is a bottom view of a floor processing device according to the invention.
Figure 1:
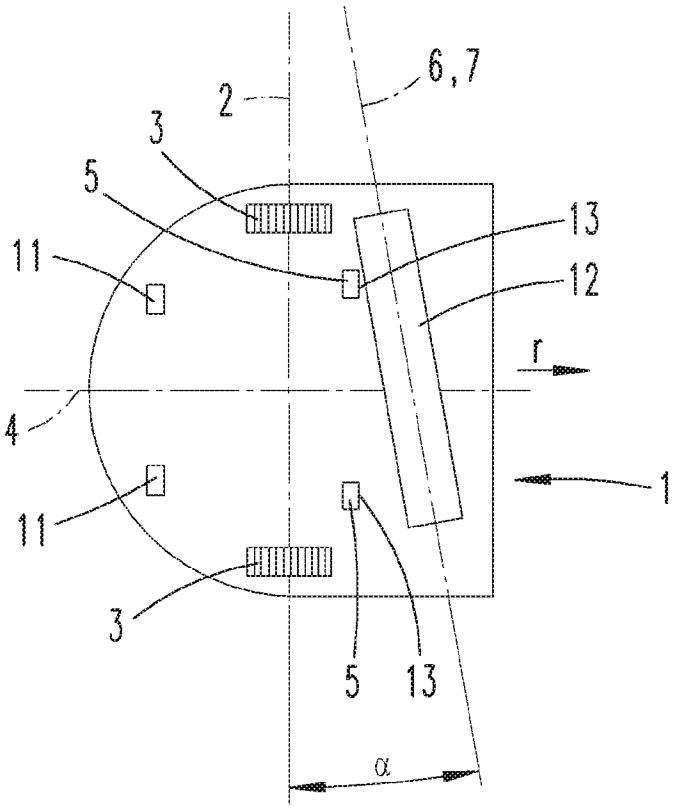

FIGS. 4 and 5 show a first embodiment, in which the contact elements 5 are arranged laterally offset one behind the other relative to the forward direction r of the floor processing device 1, so that they are located at varying distances from the drive axle 2 of the drive elements 3. This simultaneously yields varying distances between the contact elements 5 and the contact element 12 designed as a bristle roller. As depicted, a connecting line 7 that imaginarily connects the contact surfaces 13 of the two contact elements 5 is resultantly not oriented parallel to the drive axle 2, wherein the drive axle 2 and connecting line 7 here have an angle $\alpha$ of 10°, for example. For example, a distance a for the contact elements 5 in a direction parallel to the central line 4 measures roughly 4 mm, while the distance a is here not shown true to scale relative to the illustrated size of the floor processing device 1.

FIG. 5 shows the floor processing device 1 according to FIG. 4 as the contact surfaces 13 of the contact elements 5 hit an obstacle 10, which here likewise can again be a door threshold. In the depicted situation, the contact element 12 designed as a bristle roller has already driven over the obstacle 10, so that the contact elements 5 designed as support wheels hit the obstacle 10. As long as the floor processing device 1 is still moving in the forward direction r shown on FIG. 4, the drive axle 2 of the drive elements 3 is still oriented parallel to the edge of the obstacle 10. As a result, a contact element 5, specifically here the lower one on the figure, initially comes into contact with the obstacle 10. This causes the floor processing device 1 to swivel around the pivot of the contact element 5 formed as a result, until the other contact element 5 (above on the figure) also hits the obstacle. The new forward direction r shown on FIG. 5 comes about in the process. As a consequence, both contact elements 5 are located at the edge of the obstacle 10 in the end position. The drive axle 2 of the drive elements 3 is thereby inclined relative to the obstacle 10, wherein the angle between the drive axle 2 and obstacle 10 corresponds to the angle between the drive axle 2 and connecting lines 7 of the contact elements 5, here specifically 10°. As the floor processing device 1 continues to move in the new forward direction r, the drive elements 3 hit the obstacle 10 at staggered times, wherein only a first of the drive elements 3 initially hits the obstacle 10 (see FIG. 5). The connecting line 7 here is spaced apart from the contact surface of the drive element 3 by a distance approaching zero in relation to the direction of movement 4, i.e., the connecting line 7 touches or intersects one of the drive elements 3 on FIGS. 4 and 5. As a result, the drive element 3 contacts the obstacle 10 essentially at the moment when the floor processing device 1 is made to stand at an inclination by the contact surface 13 hitting the obstacle 10. The drive element 3 can thus temporarily overcome the obstacle 10 directly, without there being a possibility that the floor processing device 1 will be stood up straight again before the obstacle 10 has been overcome. In order for the drive elements 3 to optimally overcome the obstacle 10, practice has demonstrated it to be sufficient that the contact surface 13 of the contact element 5, or here the connecting line 7, be spaced apart from a contact surface of the drive element 3 by a distance relative to the direction of movement of the floor processing device 1 that is unequal to zero, but less than one diameter of the drive element 3 (for example, see also FIGS. 6 and 7). The contact surface of the drive element 3 is understood to be a peripheral surface of the drive element 3 that moves ahead in the direction of movement 4, and comes into contact with the obstacle 10 first. The latter also depends not least on the height of the obstacle 10 and diameter of the drive element 3. Because the second drive element 3 on FIG. 4 is not yet in contact with the obstacle 10, it can still optimally transfer its driving force to the surface, so that the first drive element 3 can overcome the obstacle 10. The delay in the drive elements 3 hitting the obstacle 10 improves the adhesion of drive elements 3 on the surface or on the edge of the obstacle 10, thereby making it considerably easier to drive over the obstacle 10 in comparison to prior art.

Figure 6:
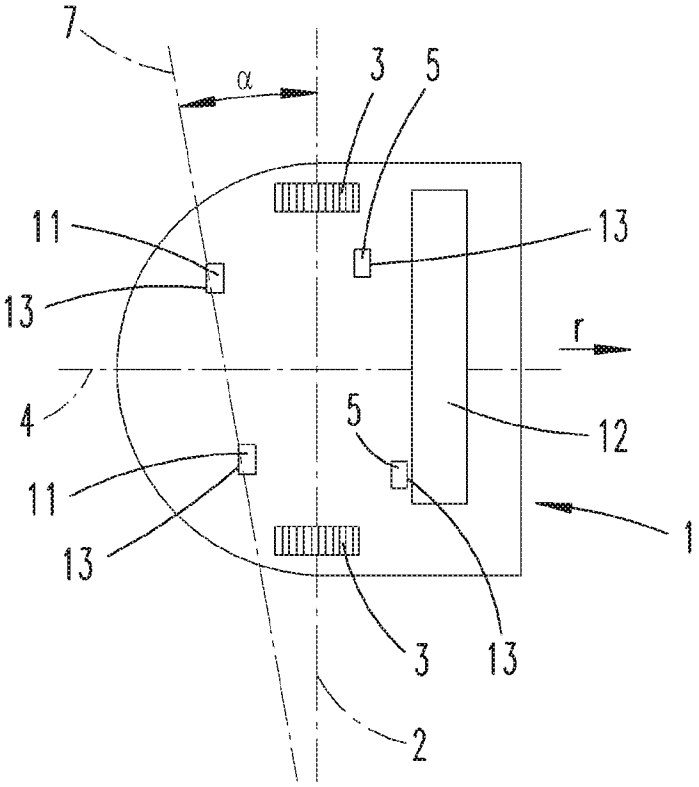
FIG. 6 is another embodiment of a floor processing device according to the invention.

FIGS. 6 and 7 show two additional embodiments of floor processing devices 1 according to the invention, in which obstacles 10 are also overcome by being forcedly driven over at an inclination.

FIG. 6 shows an embodiment in which both the contact elements 5 and the contact elements 11 are arranged offset one behind the other, so that only a respective one of the contact elements 5 or 11 initially hits the obstacle 10 both when traveling in the forward direction r and traveling against the forward direction r. The contact elements 11 here serve to better overcome an obstacle 10 while the floor processing device 1 travels in reverse, i.e., while the floor processing device 1 moves opposite the usual forward direction r.

FIG. 7 shows another embodiment in which the contact element 12 designed as a bristle roller has an angle α unequal to 0' relative to the drive axle 2 of the drive elements 3. In this embodiment, only one of the two axial end areas of the contact element 12 initially comes into contact with the obstacle 10 as the floor processing device 1 approaches the obstacle 10. The opposing end area of the contact element 12 only hits the obstacle 10 at a later time. When both end areas of the contact element 12 have finally contacted the obstacle 10, the floor processing device 1 has an inclined position relative to the edge of the obstacle 10, wherein the drive axle 2 and the edge of the obstacle 10 to be overcome are not oriented parallel to each other. In this inclined position, only one of the drive elements 3 first comes into contact with the obstacle 10, while the respective other drive element 3 can still exert its entire force on the surface.

In the exemplary embodiments according to FIGS. 6 and 7, the distance between the connecting line 7 of the contact element 12 (FIG. 7) or connecting line 7 of the contact surface 13 of the contact elements 11 (FIG. 6) and a contact surface of the drive element 3 is greater than zero, and less than the diameter of the drive element 3. Depending on the size of the obstacle 10 and the diameter of the drive element 3, the contact surface of the drive element 3 relative to the depicted top view lies somewhere between the drive axle 2 and running surface contour of the drive element 3, and is oriented essentially parallel to the drive axle 2.

REFERENCE LIST

1 Floor processing device
2 Drive axle
3 Drive element
4 Central line
5 Contact element
6 Rotational axis
7 Connecting line
8 Housing
9 Distance measuring device
10 Obstacle
11 Contact element
12 Contact element
13 Contact surface
α Angle
a Distance
r Forward direction

What is claimed is:

1. An automatically moving floor processing device comprising:

a housing, at least one drive element that is driven by an electric motor and is configured to rotate around a drive axle for movement purposes, and at least one contact element that moves ahead of the drive element in a direction of movement, the contact element extending from an underside of the housing in a direction of a surface to be processed, wherein a contact surface of the contact element pointing in the direction of movement is oriented nonparallel to the drive axle of the drive element, and is spaced apart from a contact surface of the drive element by a distance relative to the direction of movement that is less than one diameter of the drive element, wherein the contact element extends underneath the housing toward the surface to be processed in a use position, but is spaced apart therefrom.

2. The floor processing device according to claim 1, wherein the floor processing device has two of said contact elements, which are laterally offset relative to each other one behind the other in relation to the direction of movement.

3. The floor processing device according to claim 2, wherein the contact elements are spaced apart from each other by a distance of 3 mm to 10 mm, in a direction orthogonal to the drive axles.

4. The floor processing device according to claim 1, comprising at least two of said drive elements, whose drive axles lie on a shared line, or which have a shared drive axle.

5. The floor processing device according to claim 1, wherein the drive element is a motor-driven wheel or a motor-driven floor processing roller.

6. The floor processing device according to claim 1, wherein the contact element is a motor-driven wheel, a guide wheel that passively co-rotates during the movement of the floor processing device, or a floor processing element.

7. The floor processing device according to claim 1, wherein the contact element moves ahead of the drive element in relation to a movement of the floor processing device in a forward direction.

8. The floor processing device according to claim 1, wherein the drive axle of the drive element and a contact surface of the contact element or a connecting line connecting two contact elements are disposed relative to each other at an angle unequal to zero.

9. The floor processing device according to claim 8, wherein the angle is more than 5° and less than 15°.

10. An automatically moving floor processing device comprising:

a housing, at least one drive element that is driven by an electric motor and is configured to rotate around a drive axle for movement purposes, and two contact elements that move ahead of the drive element in a direction of movement, the contact elements extending from an underside of the housing in a direction of a surface to be processed, wherein a connecting line that connects contact surfaces of the two contact elements is oriented nonparallel to the drive axle of the drive element, and is spaced apart from a contact surface of the drive element by a distance relative to the direction of movement that is less than one diameter of the drive element, wherein the contact elements extend underneath the housing toward the surface to be processed in a use position, but is spaced apart therefrom.

* * * * *